US006295370B1

(12) United States Patent
D'Hooge

(10) Patent No.: US 6,295,370 B1
(45) Date of Patent: Sep. 25, 2001

(54) BLOCKY PICTURE TEMPLATE GENERATOR

(75) Inventor: Herman D. D'Hooge, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/197,500

(22) Filed: Nov. 23, 1998

(51) Int. Cl.[7] ..... G06K 9/00
(52) U.S. Cl. ..... 382/162; 382/209
(58) Field of Search ..... 382/162, 163, 382/164, 165, 166, 167, 168, 169, 170, 171, 172, 173, 174, 209, 215, 217, 218, 219

(56) References Cited

U.S. PATENT DOCUMENTS 5,383,036 * 1/1995 Mailloux et al. ..... 358/518
5,746,656 * 5/1998 Bezick et al. ..... 463/42

* cited by examiner

*Primary Examiner*—Phuoc Tran
*Assistant Examiner*—Amir Alavi
(74) *Attorney, Agent, or Firm*—Kenyon & Kenyon

(57) ABSTRACT

A system creates a template for use with a number of colored pieces in a patterned children's game or similar application. The colored pieces are formed of a plurality of colors and at least one size. The system generates a digital image. The system then pixelates the image based on the number of colored pieces and the at least one size. The system then color adjusts the image based on the plurality of colors.

25 Claims, 3 Drawing Sheets

BLOCKY PICTURE TEMPLATE GENERATOR

FIELD OF THE INVENTION

The present invention is directed to a computerized template generator. More particularly, the present invention is directed to a computerized blocky picture template generator that can be used with colored pieces.

BACKGROUND OF THE INVENTION

There exist several traditional and popular non-computerized children's games where the child constructs patterns by placing colored game pieces in some interesting configuration on a board. The game pieces can include blocks, pins with colored heads, colored light bulbs that light up when placed on the board, and other types of colored elements. Specific commercial products of these type of games ("pattern games") include "Lite-Brite" by the Milton Bradley Corp., "Sparkle Lights" by the Ohio Arts Corp., "Fantastic Sand" by the Kenner Corp., and "Lego" blocks by the Lego Corp.

Although there is no inherent limitation on the kinds of patterns that can be built using these games, specific templates of interesting patterns (such as animals, clowns, cars, etc.) are often provided to enable the child to actually construct something that is recognizable. However, these templates typically are included with the games, and are not personal to the child. Thus, these pattern games generally offer either total freedom of creation (if the templates are not used), which allows most children to create very trivial results, or a fixed non-personalized type of creation which allows more interesting results (if the templates are used).

Additionally, other applications besides children's games utilize placing colored pieces on a template. Examples include: crafts (e.g., crochet, quilting, art, etc.), architecture (e.g., tiled building decorations, sports fields, etc.), and graphical design (e.g., large billboard advertisements, etc.).

Based on the foregoing, there is a need for a method and apparatus for creating a personalized template that can be used with a children's pattern game or any other application that includes colored pieces that can be placed on the template.

SUMMARY OF THE INVENTION

One embodiment of the present invention is a system for creating a template for use with a number of colored pieces. The colored pieces are formed of a plurality of colors and at least one size. The system generates a digital image. The system then pixelates the image based on the number of colored pieces and the one size. The system then color adjusts the image based on the plurality of colors.

DETAILED DESCRIPTION

One embodiment of the present invention is a method and apparatus for creating templates that can be used to create personalized results when used with colored game pieces from a children's pattern game or can be used with any other application that includes colored pieces.

Figure 1:
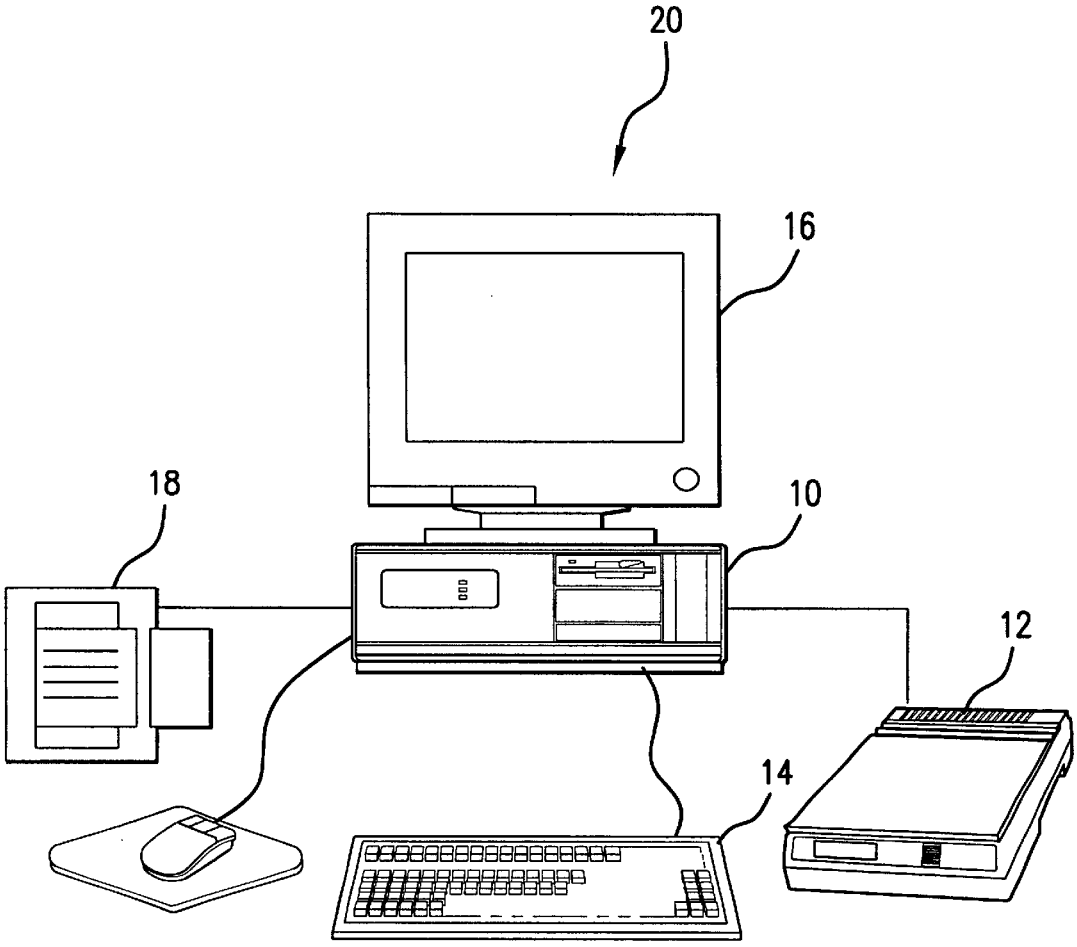
FIG. 1 is a block diagram of one embodiment of a computer system that can implement the present invention.

FIG. 1 is a block diagram of one embodiment of a computer system that can implement the present invention. Computer system 20 includes a keyboard 14, a system unit 10, a computer display 16, a scanner 12 and a color printer 18. System unit 10 includes a processor, memory, and other known computer components. Scanner 12 scans pictures for display on computer display 16 and manipulation by system unit 10. Printer 18 generates a printed color output that can function as a template for use with colored game pieces in a children's pattern game or any type of colored pieces.

Figure 2:
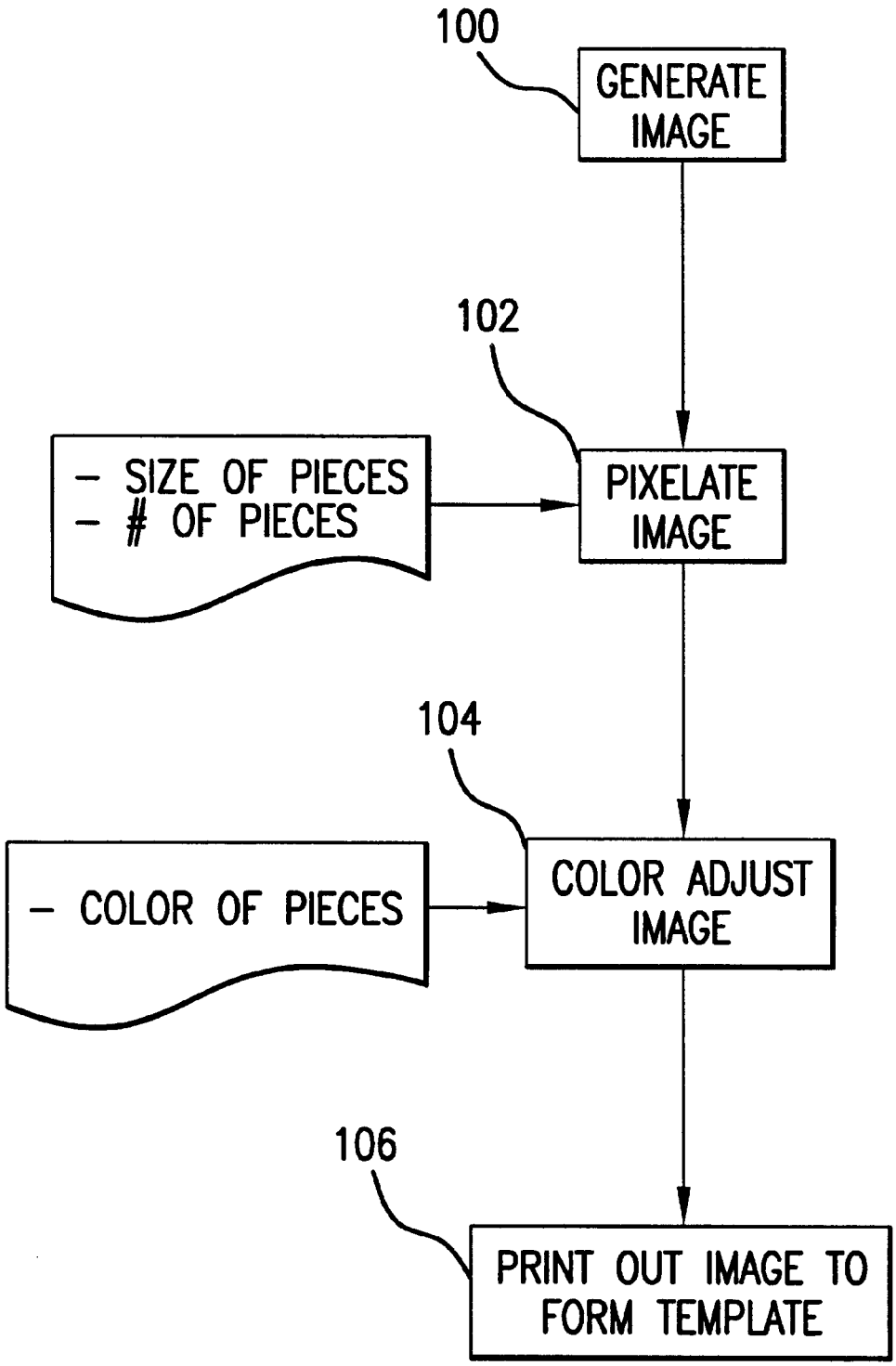
FIG. 2 is a flowchart of the steps performed by the computer system in accordance with one embodiment of the present invention to create a template.
Figure 3:
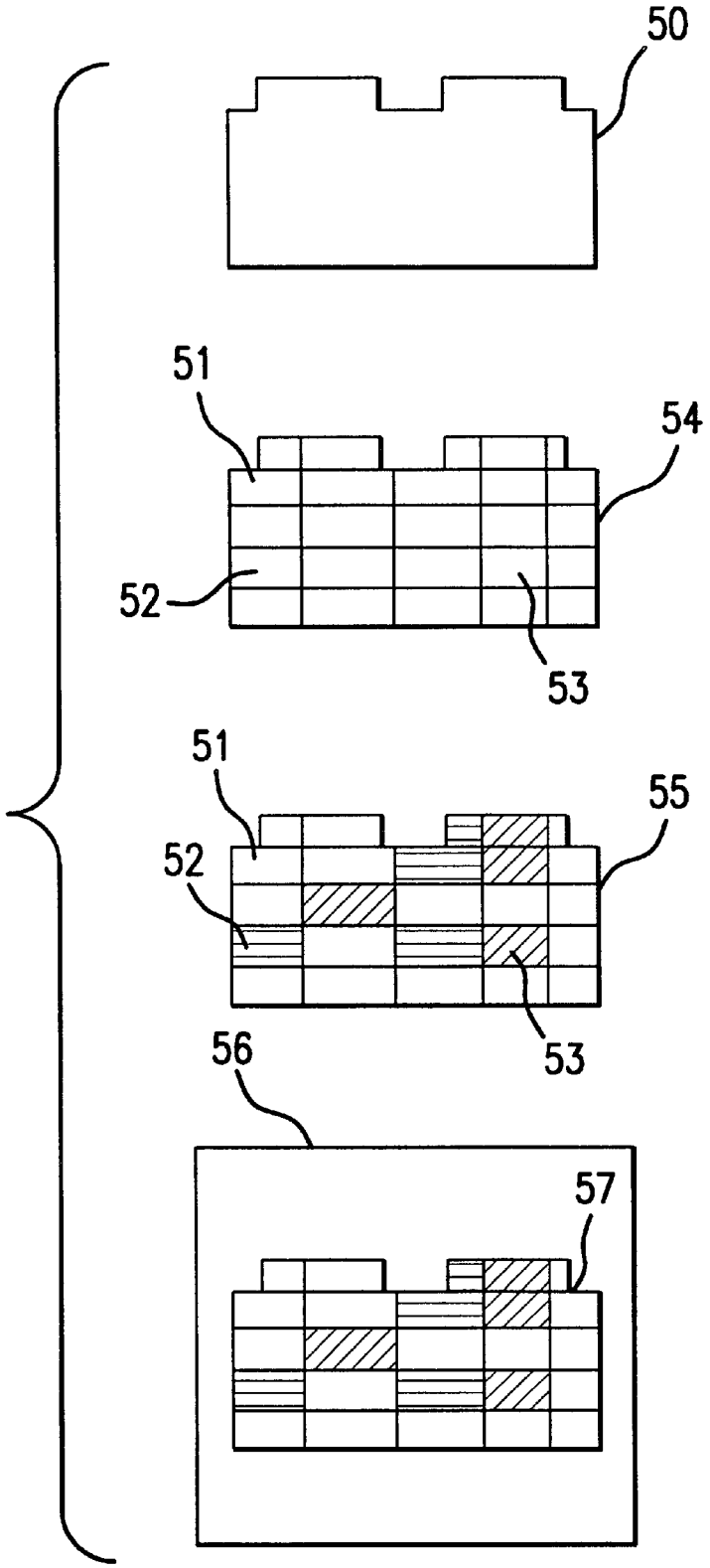
FIG. 3 illustrates the resultant output of each step of FIG. 2.

FIG. 2 is a flowchart of the steps performed by computer system 20 in accordance with one embodiment of the present invention to create a template. FIG. 3 illustrates the resultant output of each step of FIG. 2.

At step 100 of FIG. 2, the desired image for the template is generated by computer system 20. The image may be in the form of a photograph, painting, etc. In one embodiment, the image is scanned by scanner 12 and converted in a digital form. In other embodiments, a digital camera can directly capture the image, or computer system 20 can directly create an image by, for example, using pre-stored images in memory, generating an image based on some algorithm, or using a drawing program. Any other known methods to create a digital image can be used at step 100. The resultant image 50 shown in FIG. 3 can be displayed on computer display 16.

At step 102 of FIG. 2, the captured digital image is pixelated. The pixelation step matches the resolution of the image to the physical game pieces. As inputs to step 102, system 20 receives the size of the game pieces and the number of game pieces that will be used on the template. For example, the input can be "100" game pieces that are each "½-inch square". The captured image is pixelated by grouping pixels of the digital image together so that each group of pixels is the size of each game piece, and the number of groups of pixels equals the number of game pieces. In one embodiment, all game pieces are the same size. In another embodiment, the game pieces have different sizes.

The resultant image 54 shown in FIG. 3 includes pixel group blocks 51, 52, 53, etc. that are shaped like the game pieces (assuming the game pieces are block-shaped) and the number of blocks equals the number of game pieces.

At step 104 of FIG. 2, the image is color adjusted. As inputs to step 104, system 20 receives the colors of the game pieces. For each group of pixels, the color of the pixels in that group are averaged to arrive at a single color for the group. The color for the group is then compared to the available colors of the game pieces to determine which game piece color is closest. The determination can be made by calculating the distance from the group color to each game piece color and selecting the shortest distance.

Once the game piece color is determined for a pixel group, system 20 changes the color for the pixel group to match the game piece color. Therefore, for example, if a red game piece is the closest color to pixel group block 52, the color of pixel group block 52 will be changed to match the color red of the game piece.

In another embodiment, instead of changing the color of each pixel group to match a game piece color, system 20 can write a code in each pixel group block that identifies a game piece color. For example, a "1" can indicate a red game piece and a "2" can indicate a blue game piece.

The resultant image 55 shown in FIG. 3 has pixel group blocks 51–53, etc. in the shape of the game pieces, and each group has a color that matches a color of a game piece. For example, if the game pieces are red, blue, green and white, group 51 may be white, group 52 may be red, and group 53 may be blue.

At step 106 of FIG. 2, the image is printed on a color printer. The resultant template 56 shown in FIG. 3 includes the image 57 and can be used with a pattern game. Typically, template 56 can be mounted on a base that is included with the pattern game, and the game pieces can be placed directly on the template. When the game pieces are placed on the template, the block pattern, when observed from a distance, will tend to appear smooth and quasi-continuous.

In another embodiment, the image is printed on a black and white printer and includes codes that identify a colored game piece for each block. In still another embodiment, the image remains displayed on computer display 16 and is merely used as an on-screen guide for the placement of the colored game pieces.

After the game pieces are placed on the template, a digital image of the completed pattern using, for example, a digital camera, can be sent to computer system 20 in one embodiment. System 20 can then compare the completed pattern with the previously stored image and any mismatches can be identified and shown on computer display 16. This allows the child to determine how accurate the template was followed.

In one embodiment, an additional step of transforming the generated image may be performed by system 20 after step 100 to create more varieties of templates from a single image. Transforming the image can include computing special effects on the image such as morphing the image, cropping the image (i.e., using only a portion of the image), rescaling the image which may change the aspect ratio of the image, adjusting the original colors of the image (e.g., making the image brighter, or greener, or computing the "negative" of the image), etc.

As described, the present invention allows personalized templates to be created and used with children's pattern games. This increases the child's enjoyment when playing the games. Further, the present invention can be used with any type of application that utilizes templates and colored pieces to create a personalized result.

Several embodiments of the present invention are specifically illustrated and/or described herein. However, it will be appreciated that modifications and variations of the present invention are covered by the above teachings and within the purview of the appended claims without departing from the spirit and intended scope of the invention.

What is claimed is:

1. A method for creating a template for use with a first amount of colored pieces, wherein the colored pieces comprise a plurality of colors and have at least a first size, said method comprising:

(a) generating a digital image;

(b) pixelating the image based on the first amount of colored pieces and the first size; and (c) color adjusting the image based on the plurality of colors of the colored pieces.

2. The method of claim 1, wherein step (a) comprises scanning a picture.

3. The method of claim 1, wherein the image comprises a plurality of pixels and step (b) comprises:

forming a second amount of groups of pixels having a second size, wherein said second size is approximately equal to said first size, and said second amount equals said first amount.

4. The method of claim 3, wherein step (c) comprises, for each group:

determining an average color of the pixels forming the group; and determining one of the plurality of colors as being closest to the average color.

5. The method of claim 4, further comprising:

changing the color of the pixels forming the group to the determined one of the plurality of colors.

6. The method of claim 4, further comprising:

writing a code in the group, said code identifying the determined one of the plurality of colors.

7. The method of claim 1, further comprising:

(d) printing the image to form the template.

8. The method of claim 7, further comprising:

(e) capturing a second image of the colored pieces placed on the template; and (f) comparing the second image to the color adjusted image.

9. The method of claim 1, further comprising transforming the image.

10. The method of claim 1, wherein said colored pieces are game pieces from a children's pattern game.

11. A computer system for creating a template for use with a first amount of colored pieces, wherein the colored pieces comprise a plurality of colors and have at least a first size, said system comprising:

a processor;

memory coupled to said processor, said memory having software stored thereon that when executed by said processor;

generates a digital image;

pixlates the image based on the first amount of colored pieces and the first size; and color adjust the image based on the plurality of colors of the colored pieces.

12. The system of claim 11, further comprising a scanner coupled to said processor;

wherein said digital image is generated by scanning a picture with said scanner.

13. The system of claim 11, wherein the image comprises a plurality of pixels and is pixelated by forming a second amount of groups of pixels having a second size, wherein said second size is approximately equal to said first size, and said second amount equals said first amount.

14. The system of claim 13, wherein the image is color adjusted by:

determining an average color of the pixels forming the group; and determining one of the plurality of colors as being closest to the average color.

15. The system of claim 14, the image color adjusted by:

changing the color of the pixels forming the group to the determined one of the plurality of colors.

16. The system of claim 14, the image color adjusted by:

writing a code in the group, said code identifying the determined one of the plurality of colors.

17. The system of claim 11, further comprising a printer coupled to said processor;

wherein said software, when executed by said processor, prints the image on said printer to form the template.

18. The system of claim 17, further comprising a digital camera coupled to said processor;

wherein said software, when executed by said processor:

captures a second image of the colored pieces placed on the template with said digital camera; and compares the second image to the color adjusted image.

19. The system of claim 11, wherein said software, when executed by said processor, transforms the image.

20. The system of claim 11, wherein said colored pieces are game pieces from a children's pattern game.

21. A system for creating a template for use with a first amount of colored pieces, wherein the colored pieces comprise a plurality of colors and have at least a first size, said system comprising:

means for generating a digital image;

means for pixelating the image based on the first amount of colored pieces and the first size; and means for color adjusting the image based on the plurality of colors of the colored pieces.

22. The system of claim 21, wherein the image comprises a plurality of pixels and said means for pixelating comprises:

means for forming a second amount of groups of pixels having a second size, wherein said second size is approximately equal to said first size, and said second amount equals said first amount.

23. The system of claim 22, wherein said means for color adjusting comprises, for each group:

means for determining an average color of the pixels forming the group; and means for determining one of the plurality of colors as being closest to the average color.

24. The system of claim 23, further comprising:

means for changing the color of the pixels forming the group to the determined one of the plurality of colors.

25. A computer-readable medium having stored thereon instructions which, when executed by a processor, create a template for use with a first amount of colored pieces, wherein the colored pieces comprise a plurality of colors and have at least a first size, said instructions comprising:

(a) generating a digital image;

(b) pixelating the image based on the first amount of colored pieces and the first size; and (c) color adjusting the image based on the plurality of colors of the colored pieces.

* * * * *